US012612572B2

(12) United States Patent
Kindstrand et al.

(10) Patent No.: US 12,612,572 B2
(45) Date of Patent: Apr. 28, 2026

(54) BIOCHAR PURIFICATION UNIT

(71) Applicant: Meva Energy AB, Hisings Backa (SE)

(72) Inventors: Mattias Kindstrand, Sävedalen (SE); Niklas Strandberg, Höviksnäs (SE)

(73) Assignee: Meva Energy AB, Hisings Backa (SE)

( * ) Notice: Subject to any disclaimer, the term of this patent is extended or adjusted under 35 U.S.C. 154(b) by 149 days.

(21) Appl. No.: 18/368,960

(22) Filed: Sep. 15, 2023

(65) Prior Publication Data

US 2024/0101918 A1 Mar. 28, 2024

(30) Foreign Application Priority Data

Sep. 28, 2022 (SE) ..... 2251118-2

(51) Int. Cl.

| | |
|---|---|
| ***C10B 47/34*** | (2006.01) |
| ***C10B 57/02*** | (2006.01) |
| ***C10J 3/00*** | (2006.01) |
| ***C10L 5/40*** | (2006.01) |

(52) U.S. Cl.

CPC ..... *C10L 5/40* (2013.01); *C10J 3/007* (2013.01); *C10L 2200/0469* (2013.01); *C10L 2290/02* (2013.01); *C10L 2290/04* (2013.01); *C10L 2290/06* (2013.01); *C10L 2290/50* (2013.01)

(58) Field of Classification Search

CPC ..... C10J 3/007; C10B 47/34; C10B 57/02

See application file for complete search history.

(56) References Cited

U.S. PATENT DOCUMENTS

| | | | | |
|---|---|---|---|---|
| 5,946,342 | A | 8/1999 | Koslow | |
| 10,662,386 | B2 * | 5/2020 | Kelfkens | B01J 19/1812 |
| 2014/0013657 | A1 | 1/2014 | Verma et al. | |
| 2015/0259603 | A1 | 9/2015 | Hallowell et al. | |

(Continued)

FOREIGN PATENT DOCUMENTS

| | | | |
|---|---|---|---|
| BE | 1017136 | A6 | 3/2008 |
| WO | WO-2013011520 | A1 | 1/2013 |
| WO | WO-2016168894 | A1 | 10/2016 |

OTHER PUBLICATIONS

You, S. et al. 'Towards practical application of gasification; a critical review from syngas and biochar perspectives'. In: Crit Rev Env Sci Tech 2018, vol. 48, No. 22-24, pp. 1165-1213. See Abstract; pp. 1166-1168; section 1; pp. 1168-1171, section 2.1.2; pp. 1176-1183, sections 2.2-2.2.3; pp. 1192-1194, section 4.2.

(Continued)

*Primary Examiner* — Randy Boyer

(74) *Attorney, Agent, or Firm* — Harness, Dickey & Pierce, P.L.C.; Anthony G. Fussner

(57) ABSTRACT

The present inventive concept relates to a system for production and conditioning of high-quality biochar. The system comprises a gasification reactor adapted to transform biomass to syngas and biochar by a first thermochemical conversion and a biochar purification unit adapted to subject the biochar to a second thermochemical conversion and thereby prolonging conversion residence time. A first part of the biochar purification unit comprises a biochar inlet fluidly connected to the gasification reactor and a second part of the biochar purification unit, arranged downstream from the first part, comprises an inert gas inlet for purging the biochar within the biochar purification unit.

18 Claims, 3 Drawing Sheets

(56) References Cited

U.S. PATENT DOCUMENTS

2022/0267158 A1* 8/2022 Regnery ..... C10B 19/00
2022/0333822 A1* 10/2022 Sommerauer ..... F23B 50/12

OTHER PUBLICATIONS

Maliutina, K. et al. 'Comparative study on flash pyrolysis characteristics of microalgal and lignocellulosic biomass in entrained-flow reactor'. In: Energ Convers Manage 2017, vol. 151, pp. 426-438; Abstract; p. 488, section 2.2 and Figure 1; p. 429, section 2; 5 pp. 436-437, section 4.
Swedish Search Report for Swedish application No. 2251118-2 filed Sep. 28, 2022 that is the parent application to the instant application; dated Apr. 5, 2023, 8 pages.
Extended European Search Report for EP23199397.3 that claims priority to the same parent application as the instant application; dated Mar. 11, 2024; 9 pages.

* cited by examiner

BIOCHAR PURIFICATION UNIT

CROSS-REFERENCE TO RELATED APPLICATION

This application claims Swedish Patent Application No. 2251118-2 filed Sep. 28, 2022 which is incorporated herein by reference in its entirety.

TECHNICAL FIELD

The present inventive concept relates to a system for production and conditioning of high-quality biochar and to a process thereof.

BACKGROUND

Biochar is produced in a thermochemical conversion process when biomass is heated to high temperature in conditions characterized by oxygen deficit. Given that the residence time of the biomass is sufficiently long in those conditions, the biomass is fully converted to biochar. If the residence time is too short, there will be biochar formation on the surface of the biomass solid while the biomass core remains unconverted or only partly converted.

An entrained flow gasification process may lead to such a thermochemical conversion process. In entrained-flow gasifiers, fine fraction feed of a carbon containing material, an oxidant (air or oxygen), and/or steam are fed co-currently to the gasifier. This results in the oxidant and steam surrounding or entraining the feed particles as they flow through the gasifier in a dense cloud. Entrained-flow gasifiers operate at high temperature which causes rapid feed conversion. The tar, oil, phenols, and other liquids produced from devolatilization of feed inside the gasifier are decomposed into hydrogen ($H_2$), carbon monoxide (CO) and small amounts of light hydrocarbon gases.

However, since the gasification reactions occur at a very high rate, typical residence time is in the order of a few seconds, thus leading to biomass solids of a certain minimum size partly being unconverted to biochar.

Moreover, even if full conversion has taken place, the resulting biochar will still contain small levels of hydrocarbon volatiles. This is due to the physical properties of the biochar and in particular its high specific area often exceeding 400 $m^2/g$, contributing to binding of volatiles to the biochar. Thus, in order to produce a high-quality biochar, the level of remaining volatiles should be minimized.

An obvious solution to this problem would be to prolong the residence time in the entrained flow gasifier itself. That could for example be achieved by making the entrained flow gasifier larger or by decreasing the flow velocity of the biomass through the gasifier vessel. However, both these approaches bring practical challenges, considerably higher investments, and loss of efficiency.

There is therefore a need for a new process with higher carbon purification efficiencies and with reduced level of hydrocarbon volatiles present in the obtained product.

SUMMARY

An object of the inventive concept is to mitigate the above problems, and to provide a system for production and conditioning of high-quality biochar which, at least to some extent, has higher carbon conversion efficiency than prior art solutions. This, and other objects apparent in the following, are accomplished by means of a system defined in the accompanying claims.

According to a first aspect of the inventive concept, a system for production and conditioning of high-quality biochar is provided. The system comprises:

- a gasification reactor adapted to transform biomass to syngas and biochar by a first thermochemical conversion; and
- a biochar purification unit adapted to subject the biochar to a second thermochemical conversion and thereby prolonging conversion residence time,
- wherein a first part of said biochar purification unit comprises a biochar inlet fluidly connected to said gasification reactor and a second part of said biochar purification unit, arranged downstream from said first part, comprises an inert gas inlet for purging said biochar within said biochar purification unit.

The system according to the inventive concept has an advantage of higher effectivity in terms of syngas generation than that obtained from a standard system due to the biochar being subjected to two separate thermochemical conversion processes; wherein the first one is being conducted in the gasification reactor and the second one in the biochar purification unit. The fluid connection between the biochar purification unit and the gasification reactor allows a continuous gas path through which the inert gas may carry released hydrocarbon volatiles from the biochar purification unit to the gasification reactor.

The system according to the inventive concept further offers the advantage of providing a purer biochar compared to a standard system. The system may for this reason be described as a biochar purification system.

The first thermochemical conversion takes place in the gasification reactor. The gasification reactor may be an entrained flow gasifier. The entrained flow gasifier may have a cyclonic particle separator which serves as a collector and feeder of biomass to the transportation system within the biochar purification unit.

The second thermochemical conversion takes place in the biochar purification unit which may be described as a biochar screw. The biochar purification unit serves at least two purposes. First, it receives biochar that has been subjected to a first thermochemical conversion in the gasification reactor and screw-feeds the biochar through a heated vessel having a deficit of oxygen, thereby subjecting the biochar to the second thermochemical conversion. The screw-feeding facilitates mixing of solids and gas, enabling an even heating and release of more syngas from the biochar. Because the biochar is subjected to prolonged residence time, full conversion of the biomass to biochar and release of remaining hydrocarbon volatiles from the biochar is enabled as well as synthetisation of additional syngas which improves the efficiency of the system.

The second purpose of the biochar purification unit is to purify the biochar. To this end, the biochar purification unit comprises an inert gas inlet for purging of the biochar with inert gas to carry the remaining hydrocarbon volatiles from the biochar to the gasification reactor. The biochar obtained from the biochar purification unit is thus purer than the biochar obtained directly from the gasification reactor, i.e., the biochar that has been subjected to only one thermochemical process.

In order to realise these two purposes, the biochar purification unit may comprise at least two parts provided in sequence, i.e., the first part and the second part. A biochar inlet is located in the first part of the biochar purification unit and the inert gas inlet is located in the second part of the biochar purification unit. Hereby, the second thermochemical conversion process may be conducted primarily or solely in the first part of the biochar purification unit and the purging of the biochar may be conducted primarily or solely in the second part of the biochar purification unit. The second part being provided sequentially after the first part enables purging of the biochar with inert gas to be conducted on fully converted biochar, i.e., on biochar that has been subjected to a second thermochemical conversion.

Furthermore, the location of the inert gas inlet in relation to the biochar inlet enables the inert gas to flow in a counter-current direction in relation to the biochar. Hereby, the biochar purification unit may comprise an inert gas inlet for counter-current purging of the biochar with inert gas to carry the remaining hydrocarbon volatiles from the biochar to the gasification reactor. It should be noted that the biochar inlet may also serve as a gas outlet for purged gases. The purged gases may then be fed back to the gasification reactor and added to the gas formed therein.

The second thermochemical conversion starts when the biochar enters the biochar purification unit as a result of that the biochar coming from the gasification reactor is hot and that air is present in the biochar purification unit. In order to enhance the second thermochemical conversion, the biochar purification unit may however comprise an oxidant gas inlet which allows for additional oxidants, such as oxygen or air, to be added. The oxidant gas inlet is preferably provided in the first part of the biochar purification unit, downstream from the biochar inlet. Accordingly, the biochar purification unit may comprise an oxidant gas inlet located in the first part of the biochar purification unit.

The oxidant gas inlet and the inert gas inlet being provided in different parts of the biochar purification unit gives the advantage that purging of the biochar with inert gas may be conducted sequentially after the exposure of the biomass and/or biochar to oxidants. This may be expressed as a change of lambda-value. In the gasifier, the lambda value may be approximately 0.25. In the first part of the biochar purification unit, the lambda value may be 0.1-0.2. In the second part of the biochar purification unit, where the inert gas purging is taking place, the lambda value may be 0. Hence, syngas generation may occur primarily or only in the first part of the biochar purification unit.

The biochar purification unit may comprise a gas outlet for syngas and purged gases located in the first part of the biochar purification unit. Hereby, the gas outlet and the biochar inlet may be located in the same part of the biochar purification unit. The gas outlet may be the same as the biochar inlet, meaning that syngas and purged gases are allowed to exit the biochar purification unit through the same inlet as the biochar enters the biochar purification unit. Alternatively, the gas outlet may be separated from the biochar inlet.

The gas outlet may be fluidly connected to the gasification reactor in order to allow for a continuous gas path and to enable feeding of syngas and purged gases back to the gasification reactor. Feeding the syngas and purged gases back to the gasification reactor is beneficial for the process in that the conversion residence time for the gas is prolonged, enabling larger molecules to be cracked to smaller molecules.

The biochar purification unit may have a substantially smaller capacity measured in kg/h in comparison to the gasification reactor. This means that the biochar purification unit may be relatively small in comparison with an alternative setup not having a gasification reactor upstream from the biochar purification unit. On the other hand, in order to accommodate two parts in the biochar purification unit with different lambda value, as previously described, the length of the biochar purification unit may be important. In particular, the length of the first part of the biochar purification unit, in which the second thermochemical conversion take place may be important. The biochar purification unit may have a length from 1 to 8 meters, such as from 3 to 6 meters. The length of first part may be from 1 to 3 meters, such as 2 meters.

The fluid connection between the gasification reactor and the biochar purification unit allows the biochar purification unit to be heated at least partly by the biochar itself, i.e., the heat of the biochar from the gasification reactor may be utilized for further conversion. However, the biochar purification unit may also comprise external heating means, such as a heat-exchanger or an electric heater. Furthermore, as it is preferable to maintain temperature in the biochar purification unit while at the same time having a 0-lambda zone, heat is preferably provided by other means than through the supply of air. The biochar purification unit may therefore be heated from the outside by a heat exchanger or by electricity.

According to a second aspect of the inventive concept, a process for production and conditioning of high-quality biochar is provided. The process comprises:

i) providing a system as described above, the system comprising a gasification reactor and a biochar purification unit;
ii) in the gasification reactor, transforming biomass to syngas and biochar by a first thermochemical conversion;
iii) feeding the biochar to the biochar purification unit to transform the biochar into partly purified biochar and syngas by a second thermochemical conversion; and
iv) in the biochar purification unit, purging the partly purified biochar with inert gas to carry remaining hydrocarbon volatiles from the partly purified biochar.

The biomass is hereby subjected to a three-step conversion process. First, it is subjected to gasification, second it is subjected to a pyrolysis screw process and third, it is subjected to biochar purging/cleaning. The purging serves three purposes: to clean the final biochar product, to release more energy gas from the biochar, and to increase the specific area of the biochar (as less volatiles are blocking the pores).

Examples of inert gas used in step iv) may be nitrogen ($N_2$) or carbon dioxide ($CO_2$). Nitrogen or carbon dioxide beneficially allows remaining hydrocarbon trapped in the partly purified biochar to escape without causing a reaction with the partly purified biochar itself. Hence the purging with nitrogen or carbon dioxide ensures that more energy gas is released, resulting in a pure biochar with increased specific area, without decreasing the amount of biochar.

The inert gas may be fed at a pressure over atmospheric pressure, such as 0.3 to 1.5 bar or 0.6 to 1.2 bar over atmospheric pressure. Syngas and purged gases may thus flow in a counter-current direction to the transportation direction of the screw and back to the gasifier, driven by the over pressure. Stated differently, the inert gas may be caused to move in a counter-current direction to a screw transportation direction of the biochar purification unit.

The process may comprise a step of feeding the purged gases back to the gasification reactor. Feeding the gas back to the gasification reactor is beneficial in that the conversion residence time for the gas is prolonged, thereby enabling cracking of larger molecules to smaller molecules.

The process may comprise a step of feeding an oxidant into the biochar purification unit to promote the second thermochemical conversion. The oxidant may be oxygen or air. The step of feeding an oxidant into the biochar purification unit is preferably performed prior to the step of purging the biochar with inert gas. In other words, it is preferable that the last step of purging the biochar with inert gas happens sequentially after the exposure of the biomass/biochar to oxygen. This can be expressed as a change of lambda value. The lambda value in the biochar purification unit may be lower than the lambda value in the gasification reactor. In the gasification reactor, the lambda value may be approximately 0.25. In the first part of the biochar purification unit, it may be 0.1 to 0.2. In the second part of the biochar purification unit, where the inert gas purging is taking place, the lambda may be 0. Accordingly, the first part may have a lambda value of 0.1 to 0.2 and the second part may have a lambda value of 0. The first part of the biochar purification unit may thus have a higher lambda value than the second part of the biochar purification unit.

The biochar purification unit may use residence time rather than temperature as a mechanism for conversion. This also means that the biochar purification unit may consume less air for the conversion. Air increases the temperature but reduces the energy content of the gas. The residence time of the biochar in the biochar purification unit may be from 2 to 20 minutes, such as 5 to 15 minutes or 10 to 12 minutes.

The screw speed may be variable and therefore adaptable to a variation of biomass solid size. Variable speed is beneficial in that it may create tolerance for feedstock size variation. The feeding velocity of the biochar through the biochar purification unit may be 0.002 to 0.07 m/s, such as 0.01 to 0.05 m/s.

BRIEF DESCRIPTION OF THE DRAWINGS

In the following description, the present inventive concept is described with reference to a biochar purification system for production and conditioning of high-quality biochar.

DETAILED DESCRIPTION

Figure 1A:
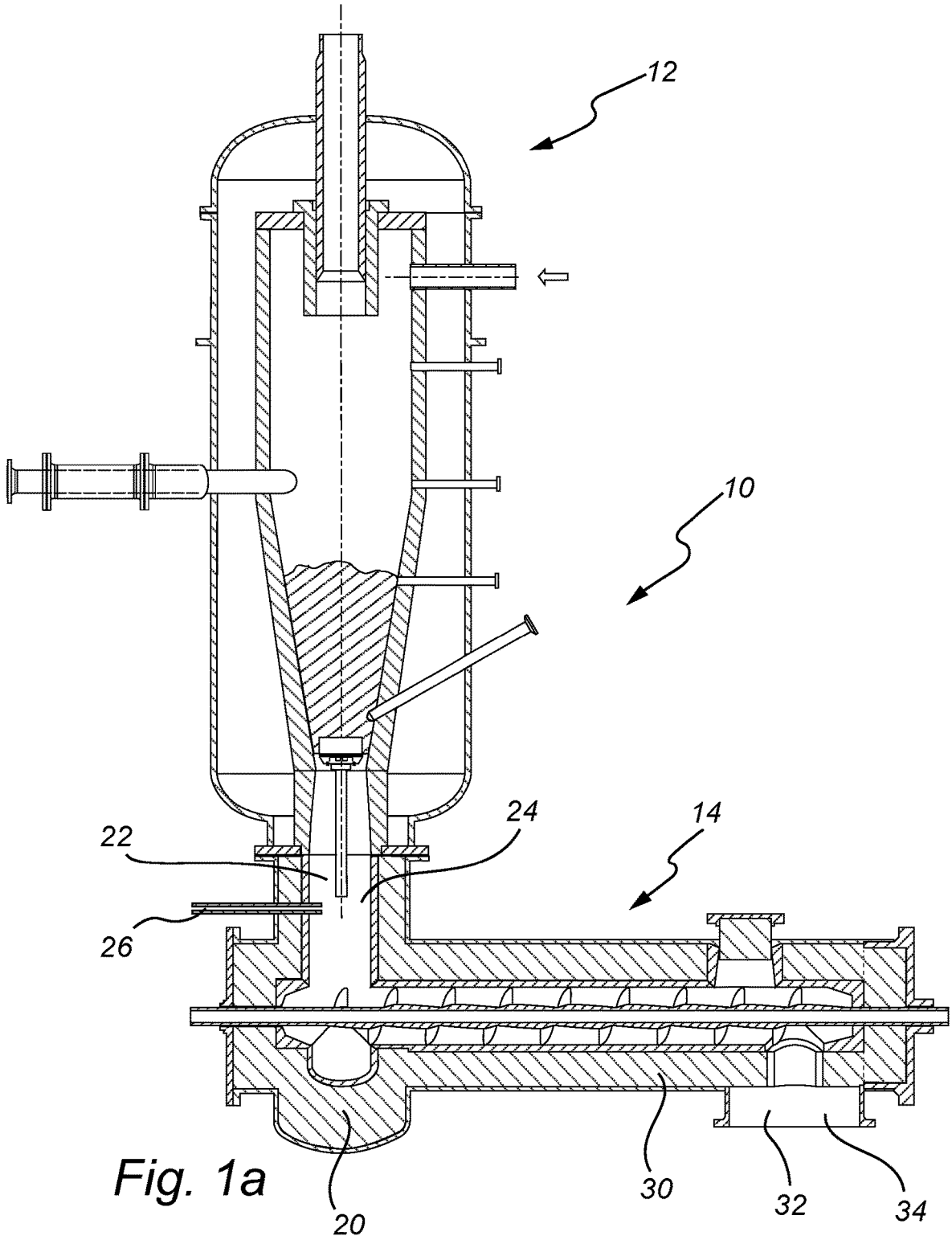
FIG. 1*a* illustrates a system for production and conditioning of high-quality biochar according to at least one example embodiment of the inventive concept.

FIG. 1*a* illustrates a system 10 for production and conditioning of high-quality biochar. The system 10 comprises a gasification reactor 12 and a biochar purification unit 14 fluidly connected to an outlet of the gasification reactor 12. The gasification reactor 12, which may be an entrained-flow gasification reactor 12, is adapted to transform biomass to syngas and biochar by a first thermochemical conversion. The biochar purification unit 14 is adapted to subject the biochar that exits the gasification reactor 12 to a second thermochemical conversion, thereby prolonging the conversion residence time. The biochar purification unit 14 is thus adapted to receive the biochar from the biochar reactor 12 and subject the biochar to further thermochemical conversion. The length of the biochar purification unit 14 may be in the interval between 1 to 8 meters, such as 3 to 6 meters.

The biochar purification unit 14 in FIG. 1*a* comprises a first part 20 and a second part 30. The first part 20 comprises a biochar inlet 22, a gas outlet 24, and optionally an oxidant gas inlet 26 for oxygen and/or air and the second part 30 comprises a biochar outlet 34 and an inert gas inlet 32.

In FIG. 1*a*, the first part 20 is located adjacent to the gasification reactor 12, e.g., towards a first end of the biochar purification unit 14, and the second part 30 is located remote from the gasification reactor 12, e.g., towards a second end of the biochar purification unit 14. Hereby a first end of the biochar purification unit 14 is located in the first part 20 and a second end of the biochar purification unit 14 is located in the second part 30. However, the biochar purification unit 14 according to the inventive concept may comprise more than two parts, such as a three or four parts. Hence, the second part 30 may not be located towards the second end of the biochar purification unit 14 as in FIG. 1*a*.

The biochar that exits the gasification reactor 12 is fed to the biochar purification unit 14 through a biochar inlet 22 located at the first part 20 of the biochar purification unit 14, e.g., towards the first end, and exits the biochar purification unit 14 through a biochar outlet 34 provided the second part 30 of the biochar purification unit 14, e.g., towards the second end. In case the biochar purification unit 14 comprises more than two parts, the biochar outlet 34 may be located in another part than the second part 30, such as a third or fourth part. No matter how many parts the biochar purification unit 14 comprises, the biochar outlet 34 may preferably be located towards a second end of the biochar purification unit 14.

In the first part 20 of the biochar purification unit 14, the oxidant gas inlet 26 for oxygen and/or air is provided to enhance the second thermochemical conversion of the hot biochar as it enters the biochar purification unit 14.

In the second part 30 of the biochar purification unit 14, e.g., towards the second end, the inert gas inlet 32 is provided to purge remaining hydrocarbon volatiles from the biochar and thus provide biochar of high quality. The location of the inert gas inlet 32 in the second part 30, e.g., near the second end, allows the inert gas to flow in a counter current direction to the biochar. The syngas produced in the biochar purification unit 14 and the purged gases exit the biochar purification unit 14 through a gas outlet 24 located in the first part 20. In FIG. 1*a*, the biochar inlet 22 serves as gas outlet 24 and the syngas and purged gases are fed back to the gasification reactor 12. The outlet of the gasifier fluidly connected to the biochar inlet 22 allows the biochar produced in the gasification reactor 12 to be fed to the biochar purification unit 14 at the same time as the hydrocarbon volatiles and/or produced gases is fed back to the gasification reactor 12.

Figure 1B:
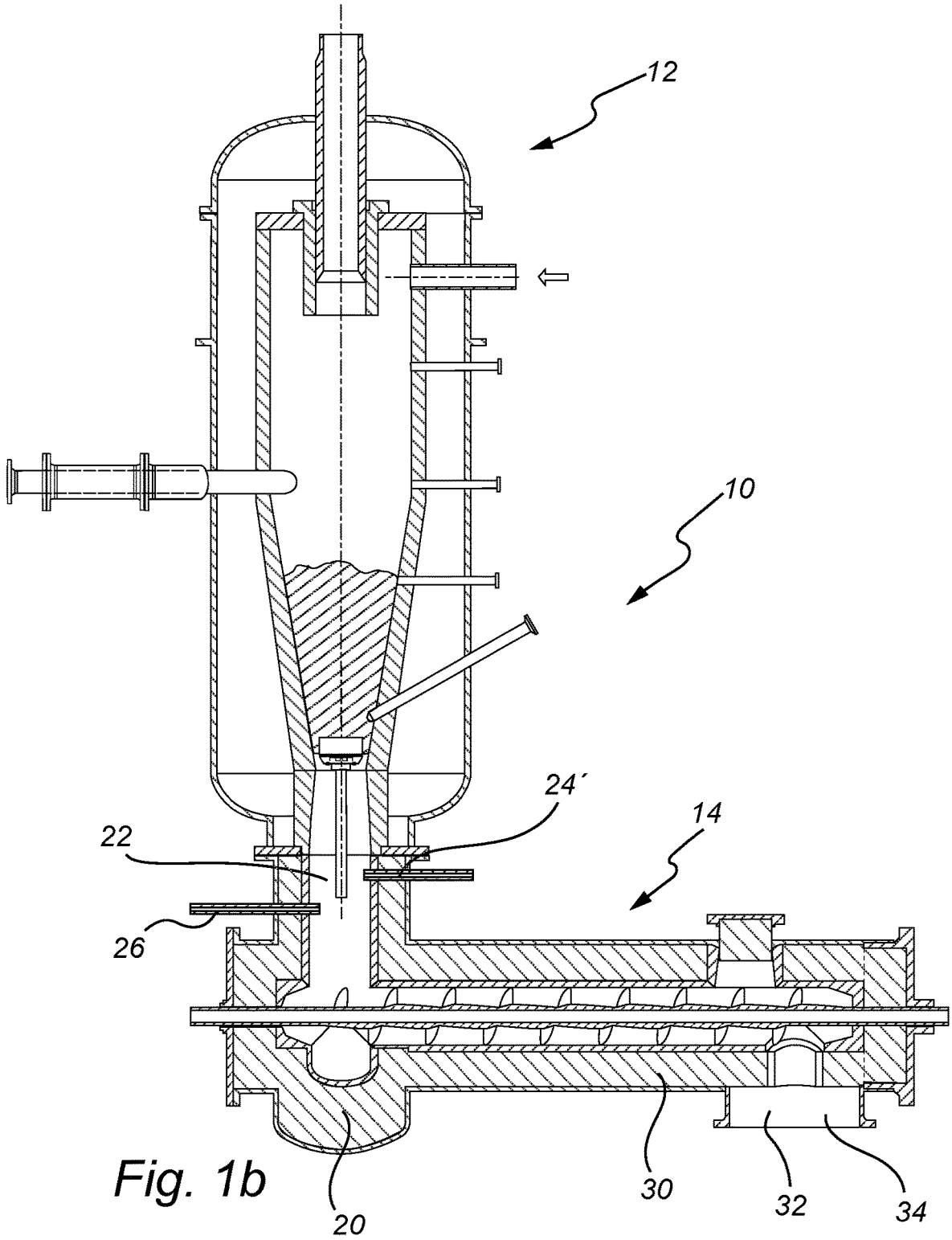
FIG. 1*b* illustrates a system for production and conditioning of high-quality biochar according to at least one example embodiment of the inventive concept.

FIG. 1*b* illustrates the system 10 for production and conditioning of high-quality biochar in FIG. 1*a* with the difference that the system in FIG. 1*b* comprises a gas outlet 24' which is separated from the biochar inlet 22.

Figure 2:
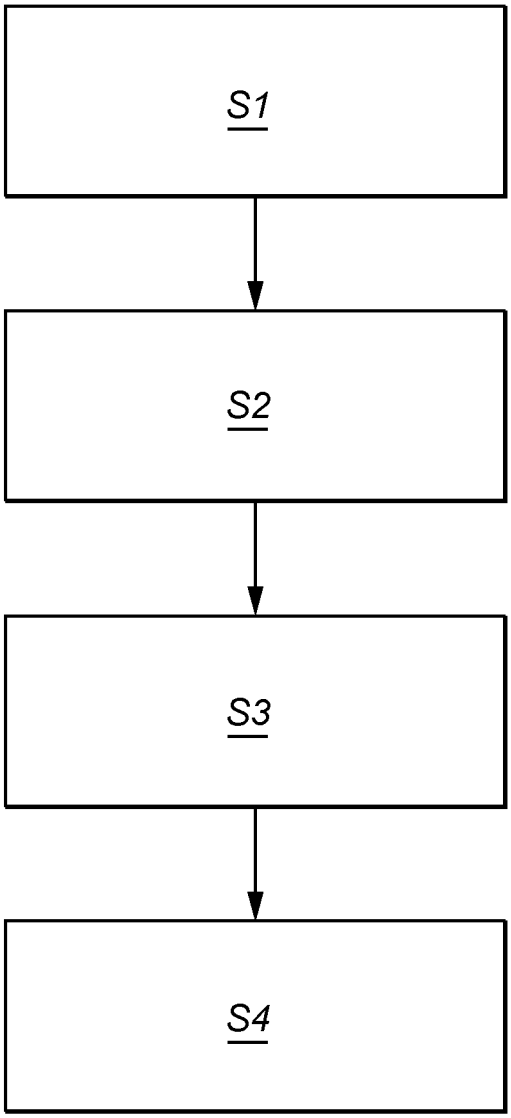
FIG. 2 illustrates a process for production and conditioning of high-quality biochar according to at least one example embodiment of the inventive concept.

FIG. 2 illustrates a schematic flow chart describing a process for production and conditioning of high-quality biochar. The process comprises a step S1 of providing a system 10 for production and conditioning of high-quality biochar. The system 10 comprises a gasification reactor 12 and a biochar purification unit 14 fluidly connected to the gasification reactor 12. The gasification reactor 12 may be an entrained-flow gasification reactor 12.

Next, biomass is fed to the gasification reactor 12 in which the biomass is transformed, S2, into syngas and biochar by a first thermochemical conversion. The temperature of the first thermochemical conversion may typically be in the interval between 850° C. to 1200° C. The residence time of the biomass in the first thermochemical conversion may typically be in the interval between 1 to seconds.

The biochar produced in the gasification reactor 12 leaves the gasification reactor 12 and is fed to the biochar purification unit 14 in which the biochar is subjected to a second thermochemical conversion. The biochar is thus transformed, S3, by a second thermochemical conversion to fully converted biochar and syngas. The biochar may be fed to the biochar purification unit 14 through a biochar inlet 22 located at a first part 20 of the biochar purification unit 14, e.g., near a first end of the biochar purification unit 14.

The temperature of the biochar entering the biochar purification unit 14 is typically in the interval between 700° C. to 1200° C. This temperature is sufficiently high for the biochar to allow for the second thermochemical conversion in the biochar purification unit 14. The temperature of the second thermochemical conversion may typically be in the interval between 700° C. to 1200° C. However, in order to enhance the second thermochemical conversion, the process may comprise a step of feeding an oxidant into the biochar purification unit 14. The oxidant may be fed in the first part 20 of the biochar purification unit 14, adjacent the first end.

The lambda value in the biochar purification unit 14 is typically lower than the lambda value in the gasification reactor 12. In the biochar purification unit 14, the lambda value in the first part 20 is typically higher than the lambda value in the second part 30. In the first part 20, the lambda value may be 0.1 to 0.2 whereas the second part 30 may have a lambda value of 0.

The residence time of the biomass and the biochar in the second thermochemical conversion and biochar purification may be in the interval between to 20 minutes. The feeding velocity of the biochar trough the biochar purification unit 14 may be 0.002 to 0.07 m/s.

In the biochar purification unit 14, an inert gas is used to purge, S4, remaining hydrocarbon volatiles from the biochar. High-quality biochar is then produced. An inert gas inlet 32 may for this purpose be provided in the second part of the biochar purification unit 14, e.g., adjacent a second end of the biochar purification unit 14. The location of the inert gas inlet 32 allows the inert gas to flow in a countercurrent direction to the biochar. The inert gas may be fed in a pressure over atmospheric pressure, such as 0.3 to 1.5 bar over atmospheric pressure in order to remove the purged gases in the countercurrent direction to the biochar in the biochar purification unit 14. The inert gas and the hydrocarbon volatiles purged from the biochar may thus be caused to flow out of the biochar purification unit 14 at the first part 20, e.g., through the biochar inlet 22, and to be fed back to the gasification reactor 12.

The invention claimed is:

1. A system for production and conditioning of biochar, said system comprising:

a gasification reactor adapted to transform biomass to syngas and biochar by a first thermochemical conversion; and a biochar purification unit adapted to subject said biochar to a second thermochemical conversion and thereby prolonging conversion residence time, wherein a first part of said biochar purification unit comprises a biochar inlet fluidly connected to said gasification reactor and a second part of said biochar purification unit, arranged downstream from said first part, comprises an inert gas inlet for purging said biochar within said biochar purification unit; and wherein said biochar purification unit comprises an oxidant gas inlet located in said first part of said biochar purification unit.

2. A system according to claim 1, wherein said gasification reactor is an entrained flow gasifier.

3. A system according to claim 1, wherein said biochar purification unit is heated at least partly by external heating means.

4. A system according to claim 1, wherein said biochar purification unit comprises a gas outlet for syngas and purged gases located in said first part of said biochar purification unit.

5. A system according to claim 4, wherein said gas outlet is fluidly connected to said gasification reactor to enable feeding of syngas and purged gases back to said gasification reactor.

6. A system according to claim 1, wherein said biochar purification unit has a length between 1 to 8 meters.

7. A process for production and conditioning of biochar with a system comprising a gasification reactor and a biochar purification unit, said process comprising:

in said gasification reactor, transforming biomass to syngas and biochar by a first thermochemical conversion;

feeding said biochar to said biochar purification unit to transform said biochar into partly purified biochar and syngas by a second thermochemical conversion;

in said biochar purification unit, purging said partly purified biochar with inert gas to carry remaining hydrocarbon volatiles from said partly purified biochar; and feeding an oxidant into said biochar purification unit to promote said second thermochemical conversion;

wherein a first part of said biochar purification unit comprises a biochar inlet fluidly connected to said gasification reactor and a second part of said biochar purification unit, arranged downstream from said first part, comprises an inert gas inlet for purging said biochar within said biochar purification unit.

8. A process according to claim 7, wherein said inert gas is selected from nitrogen ($N_2$) or carbon dioxide ($CO_2$).

9. A process according to claim 7, wherein said inert gas is caused to move in a countercurrent direction to a screw transportation direction of said biochar purification unit.

10. A process according to claim 7, comprising a step of feeding said syngas and purged gases back to said gasification reactor.

11. A process according to claim 7, wherein the lambda value in said biochar purification unit is lower than the lambda value in said gasification reactor.

12. A process according to claim 7, wherein said first part has a lambda value of 0.1 to 0.2 and said second part has a lambda value of 0.

13. A process according to claim 7, wherein the residence time of said biochar in said biochar purification unit is from 2 to 20 minutes.

14. A system according to claim 1, wherein said biochar purification unit is heated at least partly by a heat-exchanger.

15. A system according to claim 1, wherein said biochar purification unit is heated at least partly by an electric heater.

16. A system according to claim 1, wherein said biochar purification unit has a length between 3 to 6 meters.

17. A process according to claim 7, wherein the residence time of said biochar in said biochar purification unit is from 5 to 15 minutes.

18. A process according to claim 7, wherein the residence time of said biochar in said biochar purification unit is from 10 to 12 minutes.

* * * * *